United States Patent [19]

Cook

[11] Patent Number: 4,637,359

[45] Date of Patent: Jan. 20, 1987

[54] ELECTRONIC DETECTION DEVICE FOR MOTORIZED VEHICLES

[76] Inventor: Norman E. Cook, Rte. 13, McCloud Rd., Knoxville, Tenn. 37938

[21] Appl. No.: 707,968

[22] Filed: Mar. 4, 1985

Related U.S. Application Data

[63] Continuation-in-part of Ser. No. 556,989, Dec. 1, 1983.

[51] Int. Cl.[4] ..... F02N 11/08

[52] U.S. Cl. ..... 123/179 B; 180/167; 290/38 C; 307/10 R

[58] Field of Search ..... 123/179 B, 179 BG; 290/38 C, 38 E, DIG. 3; 180/167; 307/9, 10 R

[56] References Cited

U.S. PATENT DOCUMENTS

| | | | |
|---|---|---|---|
| 2,698,391 | 12/1954 | Braden et al. | 290/2 |
| 2,748,759 | 6/1956 | Schiffer | 123/179 |
| 2,836,732 | 5/1958 | Newlin | 290/38 |
| 2,975,296 | 3/1961 | Dominquez-Rego | 290/37 |
| 3,530,846 | 9/1970 | Bean et al. | 123/179 |
| 3,538,898 | 11/1970 | Egdemir | 123/179 BG |
| 3,696,333 | 10/1972 | Mott | 340/52 R |
| 3,859,540 | 1/1975 | Weiner | 290/38 |
| 3,879,705 | 4/1975 | Binder et al. | 307/10 R |
| 4,080,537 | 3/1978 | Bucher | 290/38 R |
| 4,200,080 | 4/1980 | Cook et al. | 123/179 BG |
| 4,236,594 | 12/1980 | Ramsperger | 180/167 |
| 4,345,554 | 8/1982 | Hildreth et al. | 123/179 BG |
| 4,392,059 | 7/1983 | Nespor | 290/38 D |
| 4,446,460 | 5/1984 | Tholl et al. | 340/825.69 |

OTHER PUBLICATIONS

Advertisement, TranStart, Inc., USAir Magazine, Dec., 1984, p. 21.

Owner's Manual, TranStart, Inc. Remote Starter Model GS-1000 (date unknown).

*Primary Examiner*—Andrew M. Dolinar

*Attorney, Agent, or Firm*—Woodard, Weikart, Emhardt & Naughton

[57] ABSTRACT

An automatic starting and electronic detection system for remotely starting a vehicle and scanning the vehicle's electrical system components for explosives or to detect malfunctions. The system includes a clock and remote-control receiver and transmitter combination which are electrically connected to the battery and operable to be energized for selectively connecting a current signal from the battery to the balance of the system including the starter circuit of the vehicle. The electronic detection device includes a cascade arrangement of timers for actuating various vehicle lights and accessories, and the vehicle's horn, in a predetermined sequence of sufficient duration to give a vehicle operator feedback for each step in the sequence.

10 Claims, 8 Drawing Figures

ELECTRONIC DETECTION DEVICE FOR MOTORIZED VEHICLES

CROSS-REFERENCE TO RELATED APPLICATIONS

This application is a continuation-in-part of my copending application Ser. No. 556,989, filed Dec. 1, 1983, entitled "Automatic Starting System."

BACKGROUND OF THE INVENTION

This invention relates in general to electronic devices and in particular to electronic devices arranged as an automatic control system for vehicles.

Automatic vehicular control systems represent an attempt by man to simplify a manual activity by the use of electronics. A variety of automotive electronic systems have been utilized in the past, such as systems for controlling ignition timing and fuel injection as functions of various engine parameters, and automatic starting systems.

Various remote-control engine starting systems for automobiles and other vehicles have been proposed. U.S. Pat. No. 4,200,080, issued Apr. 29, 1980 to myself and William Kirby as joint inventors, discloses an automatic starting system which includes a settable clock device in parallel with a remote-control receiver, a plurality of relays and timed thermal switches, a thermal switch flasher and solenoid coupled to the throttle-gas pedal linkage of the vehicle. Means are provided for pumping the vehicle gas pedal prior to coupling current to the starter, according to vehicle manufacturers' recommendations for starting most vehicles which have a cold engine. A number of safety features such as a hood safety switch, an overspeed switch, a temperature switch and a low oil pressure switch are provided in order to prevent damage to the vehicle and to prevent injury to others. The system includes means responsive to engine vacuum level for coupling battery power to vehicle accessory items such as an air conditioner or heater after the engine starts.

Other circuit arrangements which have been conceived in an attempt to provide improvements to automatic starting systems are disclosed in the following patents and publications:

| U.S. Pat. No. | Patentee | Issue Date |
|---|---|---|
| 2,698,391 | Braden et al. | Dec. 28, 1954 |
| 2,748,759 | Schiffer | June 5, 1956 |
| 2,836,732 | Newlin | May 27, 1958 |
| 2,975,296 | Dominguez-Rego | March 14, 1961 |
| 3,530,846 | Bean et al. | Sept. 29, 1970 |
| 3,538,898 | Egdemir | Nov. 10, 1970 |
| 3,696,333 | Mott | Oct. 3, 1972 |
| 3,859,540 | Weiner | Jan. 7, 1975 |
| 4,080,537 | Bucher | Mar. 21, 1978 |
| 4,236,594 | Ramsperger | Dec. 2, 1980 |
| 4,345,554 | Hildreth et al. | Aug. 24, 1982 |
| 4,392,059 | Nespor | July 5, 1983 |
| 4,446,460 | Tholl et al. | May 1, 1984 |

Publications: Advertisement, TranStart, Inc., USAir Magazine, December, 1984, p. 21.: Owner's Manual, TranStart, Inc. Remote Starter Model GS-1000.

Braden et al. discloses an engine-control system whereby an engine may be started and stopped automatically under the control of a clock mechanism. Also provided are means to start and stop the engine under certain temperature conditions.

Schiffer discloses an automatic starting device for an internal combustion engine which incorporates a timing mechanism for starting a car at a speed somewhat above idling speed and reducing the speed to the correct idling speed when the proper vehicle temperature is reached.

Newlin discloses an automatic car starter for automatically starting a motor vehicle at a predetermined time and energizing the motor vehicle heater at the predetermined time, whereby the automobile engine and the interior of the automobile will have had sufficient time to warm up when the operator enters the vehicle.

Dominguez-Rego discloses a clock-control circuit for energizing the ignition circuit of a vehicle, the starter and the heater and for controlling the throttle opening during the starting and warm-up periods. The circuit deenergizes the starter once the engine has started and restarts the engine if it stalls while warming up or idling.

Mott discloses an automatic automobile starter which permits utilization of either a clock-switching mechanism or a radio remote control switching system to supply current to the starter motor. Current is supplied to the ignition coil through an oil pressure switch to insure that the engine will not start unless there is sufficient oil pressure.

Bucher discloses a remote starting system for an internal combustion engine which enables the user to start the engine from a remote location using a receiver for receiving a command signal from a remote transmitter operated by the user. Provision is made for shutting down the system immediately upon any tampering with the vehicle such as by depression of the brake pedal or opening a door.

Egdemir discloses an automatic presettable car starting system for warming up the car any time during a 24-hour period by presetting the clock device. This system includes a mechanism for depressing the gas pedal a selected number of times during the cycle.

The patent to Nespor discloses a radio-controlled automatic remote car starter in which a single initial signal from the transmitter initiates an automatic engine starting and warm-up sequence which includes providing fuel to the engine, providing power to the starter, providing power to the vehicle heater and ignition, and, upon the engine reaching operating temperature and the interior of the vehicle consequently becoming heated, removing power from the ignition and heater.

Hildreth et al. disclose a remotely controlled engine starter and protective system in which an accessories timer is provided to delay energization of the heater and air conditioner for 30 seconds in order to reduce the electrical load on the battery while starting.

Weiner discloses a system for remote control of an automobile engine including visual indication of accelerator linkage and starter circuit actuation.

Bean et al. describe remote engine starting using a modulated RF carrier signal in the Citizen's Band.

Tholl et al. describe a simplified apparatus for remotely starting an internal combustion engine employing silicon-controlled rectifiers (SCRs) to switch power to the starter relay, solenoid, accessories and ignition of a vehicle. This system employs a predetermined set of coded signals.

Automatic starting systems such as those illustrated above provide significant benefits in terms of both convenience and time savings, enabling a driver to remotely start a vehicle engine so as to allow it to warm up while he continues to dress, eat or otherwise prepare for departure. Electronic systems have been used to advantage in other automotive application as well, such as engine monitoring and control, as previously stated. However, there remains a need for an automotive security system capable of adequately protecting an operator in the event explosives are wired to an electrical system component of the vehicle. Although various automotive electronic systems have been available for some time, it has not heretofore been recognized that an electronic system could offer adequate security against explosives, and as a result extremely dangerous manual bomb detection methods are still routinely employed. All the above-described remote starting systems cannot provide such security. A bomb can be electrically connected to a vehicle's headlights, horn or other electrical component where it cannot be detected merely by remotely starting the engine.

A remote starter manufactured by TranStart, Inc., featured in the above-referenced advertisement in USAir Magazine and described in detail in the above-referenced owner's manual, can automatically start a car and, through a relay, activate selected auxiliary systems such as the car's heater, defroster, air conditioner and radio. A toggle switch is provided for control of vehicle lights. As described on page 8 of the owner's manual, one terminal of this switch is connected to the relay output, and the other terminal is connected to the headlight low beam and, if desired, the parking light. As noted below the wiring diagram for the toggle switch, connecting the parking lights with the headlights causes the headlights to be activated when the parking light switch is on. Not only does the driver lose independent control of headlights and parking lights by this connection, but turning the parking light switch on causes the parking light wiring to draw headlight-level current, in excess of design specifications for that wiring. No provision is made for activating the vehicle's bright headlights. In fact, the switch installation instructions contain a note to be sure *not* to connect the wire for the headlights to the brights. Further, this system leaves all activated auxiliary systems on as long as the system itself stays on, thereby unnecessarily draining power from the charging system of the car and possibly causing a poorly idling car to stall.

One system for automatically controlling automotive starting and accessory functions, such as raising and lowering windows, controlling door locks and trunk lock, air conditioning system, heating system, headlights and radio antenna is known, and is described in the patent to Ramsperger. This system employs a remote keyboard and encoder coupled via a radio link to a microprocessor inside the vehicle, and includes particular key assignments for particular accessories. Although this system could conceivably provide some measure of safety by enabling an operator to remotely actuate a selected device, this system has several attributes making it inadequate for security use. First, individual accessories are actuated by separately depressing corresponding keys on the keyboard. An operator could not check all the controllable system components without manually stepping through all possible commands, a procedure which is subject to operator error, especially considering the number of available commands. This risk of operator error is aggravated by the fact that three keys must be depressed in a particular sequence for each desired command. Even assuming that an operator recognized that bomb detection might be possible with this system, this tedious and demanding sequence of operations would likely destroy an operator's confidence in the system. Further, for testing every circuit which can be controlled, a long series of data bits would have to be transmitted, any one bit of which could be received in error, or not received at all, due to interference or signal degradation caused by structural features of the building within which the remote transmitter is used, or other surrounding buildings, as well as by weather and excessive range. A single transmission error could be fatal to a driver who operates the car without recognizing that a selected system component has not been tested. Moreover, after activating every system component for the test, the operator would have to step through another tedious sequence of keystrokes to deactivate components.

SUMMARY OF THE INVENTION

The present invention provides an electronic detection system for motorized vehicles which includes means for remotely generating an actuation signal and responding to the actuation signal by scanning the electrical system components of a vehicle to detect the presence of explosives wired to the components or to detect circuit malfunctions.

A general object of the invention is to provide an improved, automatic control system for a vehicle.

Another object of the invention is to provide adequate security against explosives wired to electrical system components of a motorized vehicle.

Another object is to provide a simple, easily used means for enhancing the safety of operation of a motorized vehicle.

Another object is to enable step-by-step scanning of the electrical system components of a motorized vehicle in a predetermined sequence thereby eliminating operator error as a potential cause for system failure.

Other objects and advantages of the invention will become apparent from the following description of the preferred embodiment taken together with the accompanying drawings.

DESCRIPTION OF THE PREFERRED EMBODIMENT

Figure 1:
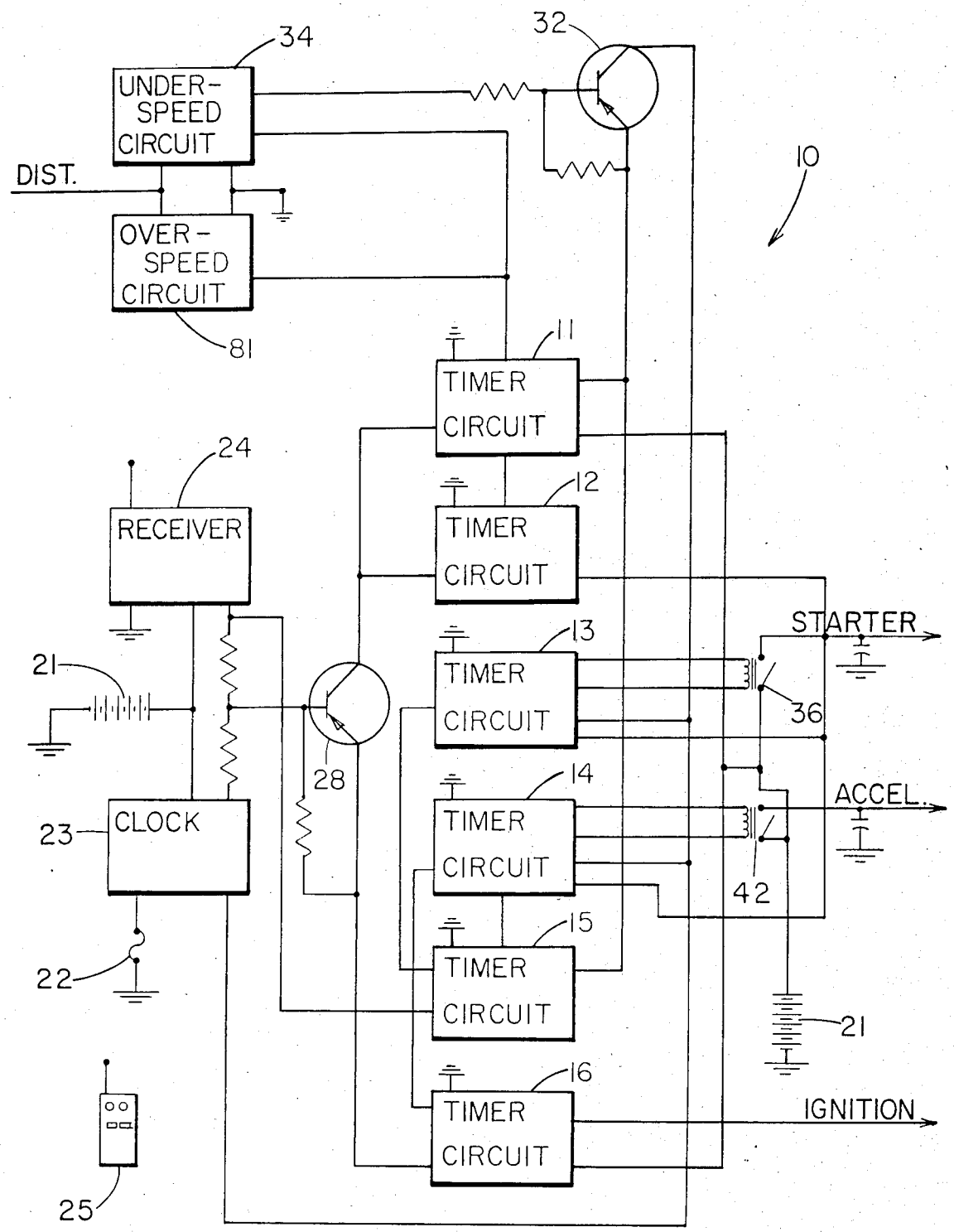
FIG. 1 is a block diagram illustration of an automatic vehicle starting system according to a typical embodiment of the present invention.
Figure 2:
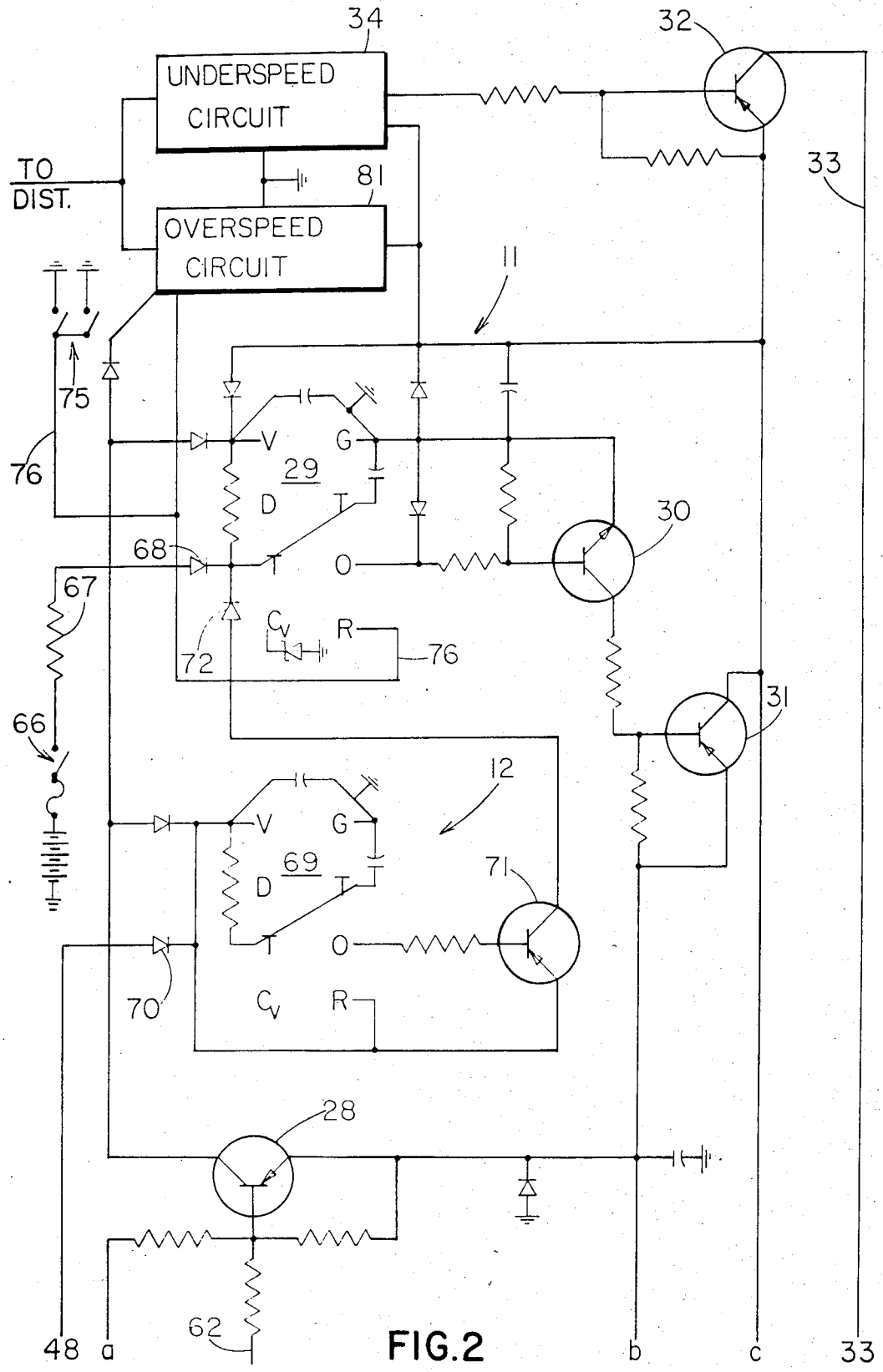
FIG. 2 is a detailed circuit illustration of one portion of the FIG. 1 block diagram.
Figure 3:
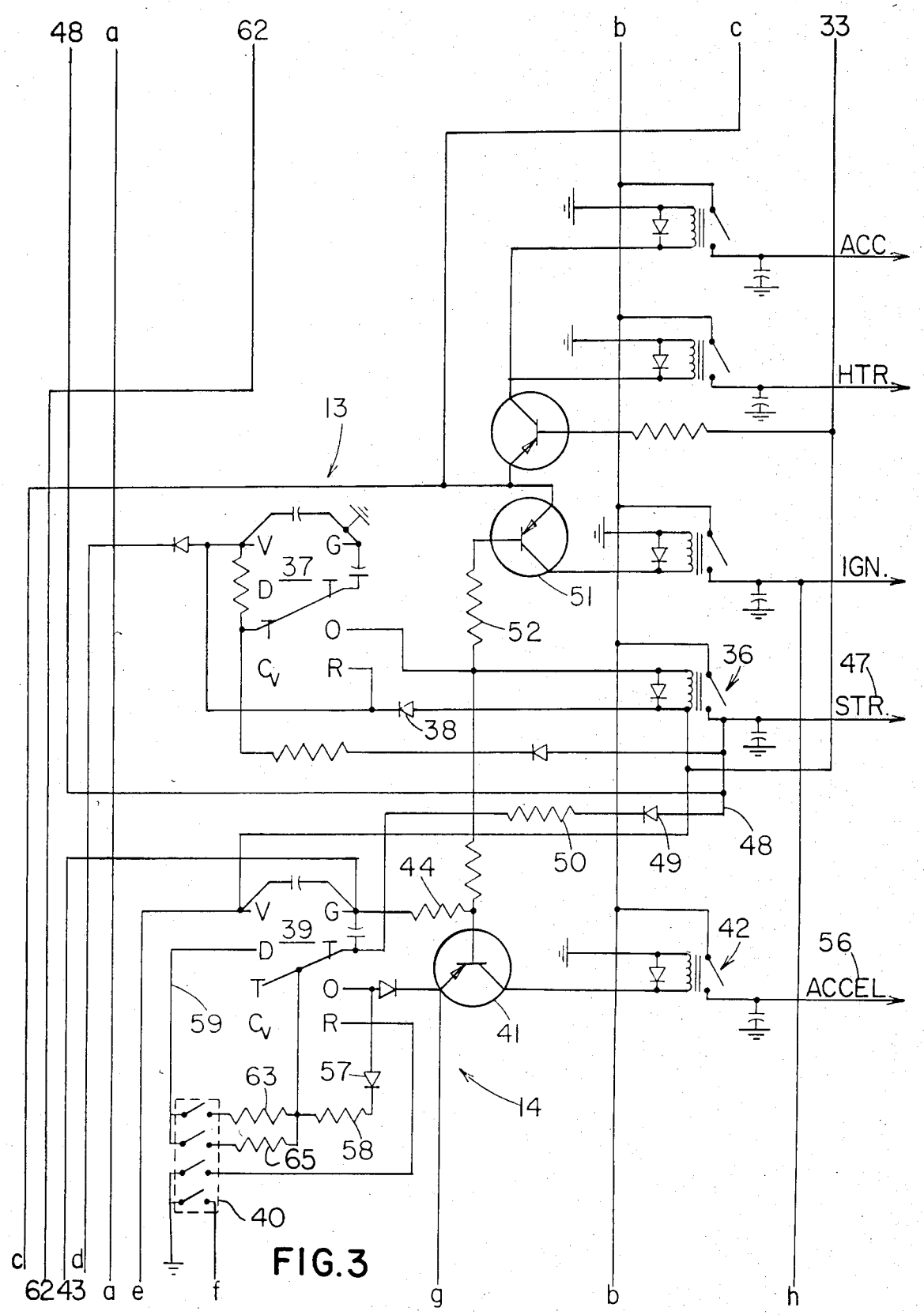
FIG. 3 is a detailed circuit illustration of one portion of the FIG. 1 block diagram.
Figure 4:
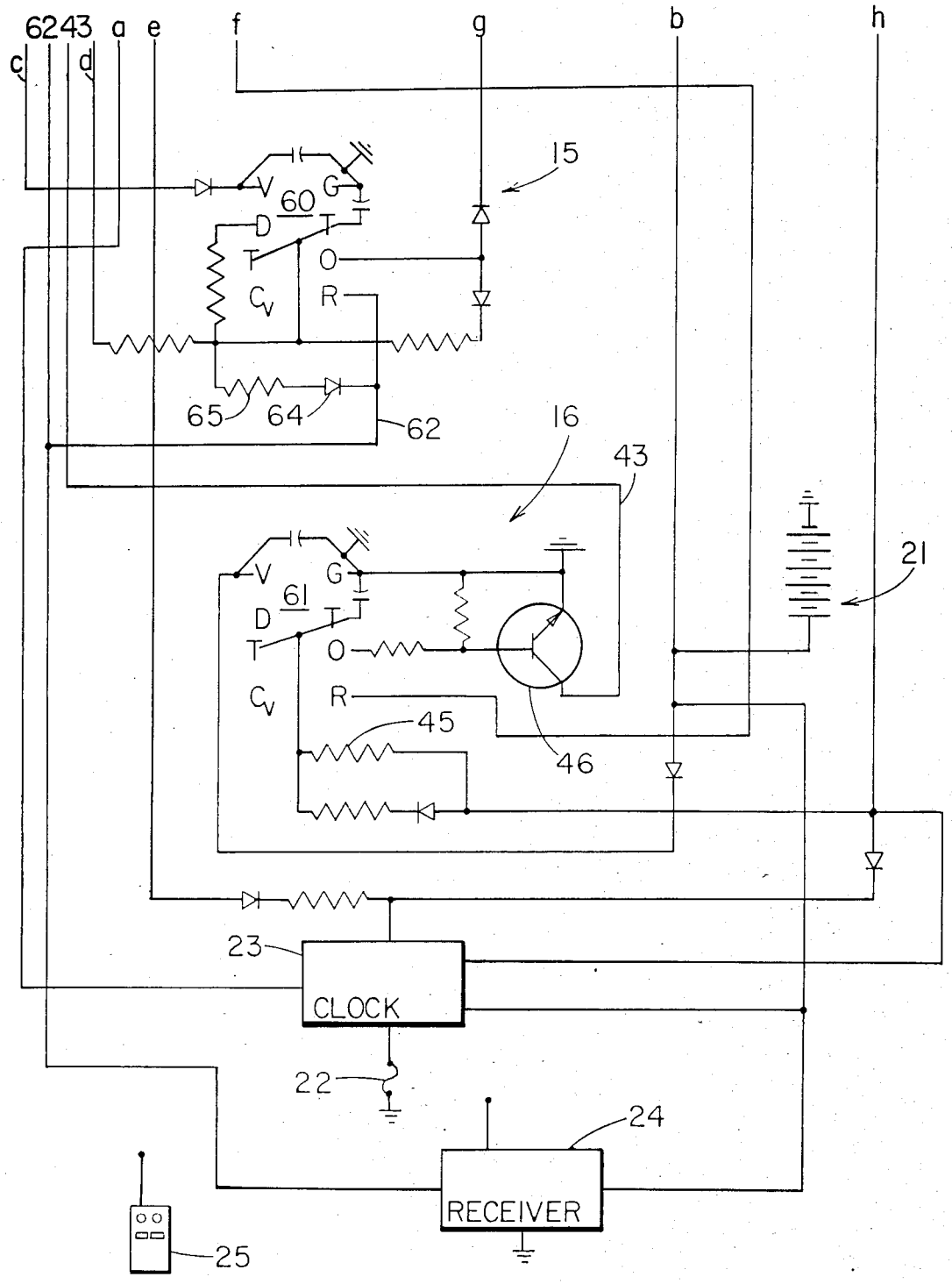
FIG. 4 is a detailed circuit illustration of one portion of the FIG. 1 block diagram.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated in diagrammatic and block diagram form automatic starting system 10 which is designed for the preselected timed starting as well as the remote starting of the internal combustion engine of a vehicle, such as for example an automobile. While every component and circuit connection is not illustrated in this diagrammatic block diagram, the main elements and functional blocks are disclosed. The circuitry of system 10 which is disclosed in greater detail by FIGS. 2–5, is energized by either clock 23 or receiver 24. The methods of activation of system 10 are described hereinafter, but for now an overview of the operation is included. The starting procedure differs according to the make and model of vehicle, as well as whether the engine is warm or cold. The nature of the engine is taken into consideration in determining how many, if any, gas pedal pumps there are to be, and when these are to occur.

After either the clock or receiver are activated, the first timer circuit 11 begins operation and assuming that it has received the proper signals and inputs, it controls the overall operational time of the system which is between 12 and 14 minutes as determined by a resistor and capacitor pair. During this time period, the timer within circuit 11 goes high and remains high unless one of the various warnings or safeguards cause interruption. For example, a brake pedal switch is present in system 10 and if activated by depressing the brake pedal, the timer in circuit 11 times out immediately.

One purpose of timer circuit 12 is to limit the starter cranking time to approximately 7 seconds, and thereafter time out the timer portion of circuit 11. With power supplied to circuit 12, its timer portion has an output which is high and by way of connecting transistor 71 keeps power off of the threshold of the timer of circuit 11. When the circuit 12 timer times out, the transistor becomes conductive sending power to the threshold of the circuit 11 timer.

Timer circuit 13 provides a delay before engaging the starter relay in order to provide a time period during which gas pedal pumping action may occur if selected for the particular vehicle. Another reason for the delay period is due to the possibility of the engine dying. This delay period assures that the engine has completely stopped running before the starter is allowed to reengage. When the timer of circuit 13 times out, its output goes low and turns on (activates) the starter relay and engages the starter.

Timer circuit 14 provides a means of either pumping the gas pedal prior to cranking, if pumping is needed, or to bypass this phase of the operation and simply depress the pedal while cranking. The choice depends upon the conditions existing within timer circuit 16. A power signal as well as a ground signal are required in order to generate gas pedal pumping prior to cranking. The necessary ground is either provided or not provided, depending upon the condition of a transistor within circuit 16. If provided, the timer of circuit 14 cycles on and off at a predetermined rate depending upon the number of pump depressions selected. If the ground signal is not present, the timer of circuit 13 will time out at which the point starter engages and power is supplied to relay 42 allowing the gas pedal to be depressed while cranking.

Timer circuit 15 provides a means for generating, either manually and/or automatically, a fast idle release by way of relay 42. The timer portion of circuit 15 recycles every two minutes (approximately) and each cycle momentarily operates relay 42 for creation of a one-half second or so depression of the gas pedal which action is the means to reduce the fast idle of the engine.

One purpose for the presence of timer circuit 16 is to provide a simulated engine temperature condition. As has been disclosed, there are reasons why attempts to sense engine temperature may prove unreliable or misleading. Consequently, the time period of engine operation relative to the engine being on or off are used as factors in order to control the timer of circuit 12 so that pumping of the gas pedal will only occur when it is required and then only to the degree and in the manner which is prescribed for the particular vehicle to which system 10 is installed. Circuit 16 includes a resistor through which the ground that is present from the ignition circuit when it is off bleeds back through in order to establish the requisite ground for the output of the timer within circuit 16 to go high. It is assumed in the design of the present system that after approximately two hours of the engine not running, it will be sufficiently cooled to require additional pumping action when it is restarted. If the engine is attempted to be restarted after it has been stopped for less than two hours, the engine is considered warm and a different pumping procedure is required.

Referring now to FIGS. 2–5, vehicle starting power is supplied by the vehicle battery 21 which also provides the requisite power to automatic starting system 10. The battery is coupled to a settable clock 23 which is in parallel with a remote control receiver 24. Ground is connected to clock 23 via fuse 22. Receiver 24 is responsive to signals from transmitter 25 in order to generate the necessary output signal for activation of the system as will be described hereinafter. Alternatively, clock 23 may be set to the desired time of day and when that time is reached, the vehicle will be automatically started as will be described hereinafter. It is also to be anticipated that starting system 10 may be provided with either receiver 24 or clock 23 or both.

As was previously discussed in the background discussion regarding the present invention, the present invention operates on a time basis rather than temperature basis depending upon how long the engine of the vehicle has been running or how long it has been standing idle, not running. Beginning with what will be considered normal conditions, assume that the vehicle engine has not been started or running for the past 2 to 2½ hours. In order to begin the procedure of remote starting of the vehicle engine, the user needs to press the activation button on the transmitter 25 for 1 or 2 seconds and thereafter release the button. As has previously been indicated, clock 23 could be preset to an exact time to start the vehicle engine, and either of these approaches are effective to activate transistor 28 (see FIGS. 2–5) which in turn sends power to timer 29. Timer 29 and its immediately surrounding circuitry are included as part of timer circuit 11. In fact, each timer circuit includes a different timer and corresponding surrounding circuitry. Circuit 12 includes timer 69, circuit 13 includes timer 37, circuit 14 includes timer 39, circuit 15 includes timer 60, and circuit 16 includes timer 61. The transmitter signal is decoded and processed by the receiver which sends a ground signal to transistor 28 causing the transistor to turn on and thereby providing power to the V+ terminal of timer 29. When the transmitter button is released, transistor 28 turns off, but timer 29 remains latched. The positive (high) output of timer 29 turns on transistors 30 and 31. Transistors 30 and 31 provide a latch-up circuit that lasts for a preselected period of time, which in the exemplary embodiment is approximately 12–14 minutes. Transistor 31 supplies controlled battery current to the balance of the system.

Once this occurs, the underspeed circuit section 34 which is a frequency-to-voltage converting circuit section receives power via transistor 31 and in turn senses that the engine is not running. This determination is made due to the fact that no input pulses from the distributor are present, and as a result underspeed circuit section 34 causes the activation or turns on transistor 32 sending power along circuit line 33, which line couples to relay 36, timer 37, diode 38 and timer 39. Circuit line 33 and the four circuit components previously mentioned constitute an underspeed delay circuit, all components of which get power at substantially the same time. The outputs of both timers 37 and 39 are high since relay 36 is not chassis grounded. Consequently, relay 36 will not operate until timer 37 times out. During this delay period for timer 37, timer 39 has both V+ and ground applied causing the timer to operate in a cyclic fashion switching between on and off status at a certain rate. This particular rate is selected by the gas pedal selector switch 40. Either 0, 1, 2 or 3 pumping activations can be selected as well as a warm or cold start mode or any sequence of pedal operations. It should be understood that the output of timer 39 which is a positive (high) voltage signal feeds into the input side of transistor 41, as illustrated. Once this transistor is turned on it supplies the engage voltage to relay 42. When timer 39 has a ground line 43, then resistor 44 turns on transistor 41.

A ground signal can be provided by timer 61 under proper circumstances. Assuming that the ignition switch has been off for at least two hours, the ground present from the ignition circuit will have had time to bleed back through resistor 45. With the ground present, the output of timer 61 goes high turning on transistor 46 which sends a ground along line 43 to timer 39 and resistor 44. With the underspeed circuit 34 activated, power is provided to the V+ terminal of timer 39 which switches high turning on transistor 41 which sends power to relay 42 resulting in activation of actuator 56. Actuator 56 is coupled to the gas pedal (throttle) linkage causing the gas pedal to be depressed for approximately 1.7 seconds. Actuator 56 is arranged with a vacuum pump and it is this combination which provides the gas pedal pumping action as generated by system 10. The output of timer 39 is connected by way of diode 57 and resistor 58 to the threshold of timer 39. Timer 39 cycles between $\frac{1}{3}$ V+ and $\frac{2}{3}$ V+ in an astable condition. When the threshold is charged to $\frac{2}{3}$ V+, the output goes low (times out) placing a ground signal on line 59 which ground signal bleeds through either resistor 63 or 65 depending upon the switch position of selector switch 40, causing the threshold to begin discharging. During this discharge phase, the gas pedal is not depressed. The duration of this discharge phase is approximately 1.7 seconds if three pumping actions have been selected, and if only two pumping actions have been selected, the time is somewhat longer, in the range of 2.5–3.0 seconds.

Assuming that we have selected the desired number of gas pedal pumps of the gas pedal circuit, these gas pedal pumps occur during the time delay of timer 37. After timer 37 times out, a period of time equal to approximately 7 seconds in the exemplary embodiment, the starter relay is engaged sending power to the park-neutral switch 47. Similarly, starter current line 48 sends power by way of diode 49 and resistor 50 to the threshold of timer 39. This immediately times out timer 39 and thereby prevents the continued pedal pumping during the period of time that there is cranking of the vehicle engine. It is also of interest to note that transistor 51 has its base connected to the output of timer 37. Transistor 51 which is a PNP transistor supplies power for the ignition relay, noting that during the delay period this transistor was in an off condition. When the output of timer 37 goes low, it turns on transistor 51 by way of resistor 52 which in turn turns on the ignition relay supplying power to the ignition circuit while cranking. After engine starting, timer 37 remains low enough to keep transistor 51 turned on even though there is no power to the V+ terminal of timer 37. Should the engine die, power will be recycled to the V+ terminal of timer 37 and the output will go high. This in turn will turn off transistor 51 and the ignition and thereby create a new time delay. If the engine was not running very long, in the exemplary embodiment less than 22 seconds, timer 39 will repump the gas pedal and timer 37 will again time out and restart the engine. Now that the engine is cranking, pulses from the distributor or diesel means are activating the underspeed frequency circuit section 34 and when enough pulses are present, the underspeed frequency circuit section turns off the ground signal to transistor 32 by way of resistor 59 thereby removing power from timer 37 by way of diode 38, timer 39 and relay 36. Once this power is removed, the vehicle engine is in what is considered to be a normal run mode with timers 29 and 60 having power. Timer 61 is connected to the battery positive voltage at all times (to retain its memory).

After starting the cold engine, it is usually running on a fast idle which helps to warm up the engine quicker, but this fast idle clearly can waste gasoline if the idle is not reduced as soon as possible after the engine is adequately warmed. Timer 60 operates in an "astable mode." That is, it will come on (output high) for about $\frac{1}{2}$ to $\frac{3}{4}$ seconds and thereafter off for approximately 2 minutes. Consequently, every couple minutes, the timer cycles on and off sending power to relay 42 thereby giving a tap on the gas pedal to reduce this fast idle down to a normal and slower idle speed saving gas and reducing engine wear. Another feature of timer 60 is that it can create a manual fast idle command. When the transmitter button is depressed, the receiver also sends a ground signal along line 62 in addition to sending it to resistor 63. This ground signal discharges the threshold of timer 60 by way of diode 64 and resistor 65. This ground signal lowers the threshold and holds the reset low turning off timer 60. When the transmitter is released, so is the ground signal and this action recycles the timer, on command from the transmitter.

The starter system can be turned off by depressing the brake pedal of the automobile causing the brake pedal switch 66 to send a plus voltage from the battery to resistor 67, diode 68 and the threshold of timer 29 causing timer 29 to turn off. The starter system can also be turned off by remote control. By holding the transmitter button down continuously for approximately 7 seconds or more, its transmission activates transistor 28 sending power to timer 69. Timer 69 is responsive to transistor 28 or the starter circuit by way of diode 70. Timer 69 and transistor 71 receive power at the same time. While the transmitter button is depressed, transistor 28 sends power to timer 69 and transistor 71. After approximately 7 seconds, the timer times out (output low) and turns on transistor 71 and sends power to the threshold of timer 29 by way of diode 72 and results in turning off timer 29. If during the cranking stage, the vehicle engine fails to start after cranking approximately 6½ to 7 seconds, timer 69 also times out by way of diode 70 and this times out timer 29 as well. If during the normal run time of approximately 12–14 minutes, which is the capacity of timer 29, should the engine overheat, for any one of various reasons, overheat temperature switch 75 which is mounted on the radiator hose will sense the overheated condition and send a ground signal along line 76 to the reset pin of timer 29 causing the timer to turn off and preventing further damage to the engine. Alternatively, switch 75 can be mounted on the heater hose or against the block.

When the engine is assumed to be warm or not needing gas pedal pumping is a fact which is determined by timer 61 and resistor 45. Since timer 39 is not grounded, its output will remain at a high level sending continuous power to the input of transistor 41; however, transistor 41 is off during the delay period of timer 37. When timer 37 times out, it will turn on transistor 41 thereby depressing the gas pedal while the starter is engaged. The gas pedal will remain depressed during the starter cranking time and will be released when the engine starts. This particular starting procedure is recommended by most late model vehicle owner manuals, and the automatic starting system 10 was specifically designed to accomplish this recommended procedure as closely as possible.

As indicated, system 10 is provided with a selector switch 40 which offers one means to tailor the system to a particular style of vehicle. This switch permits selection of one of various number of pumping actions (gas pedal depressions) or a warm or cold start mode or any combination of pedal operations. While a switch is disclosed, the tailoring of the system to a particular vehicle style could be done equally well with a hard-wire connection. The use of a switch could enable an easy operator conversion with the system remaining on the same vehicle. Alternatively, the use of a switch allows a fixed wiring procedure for the initial assembly with the appropriate switch position being selected thereafter. A hard-wired connection avoids the additional expense of a selector switch, but either approach enables the tailoring of the system to the particular vehicle. If the system is to be removed from one vehicle, it may be assembled to another with either approach being followed, simply selecting the appropriate wire connection or switch position to tailor the system to the new vehicle on which it is installed.

Figure 5:
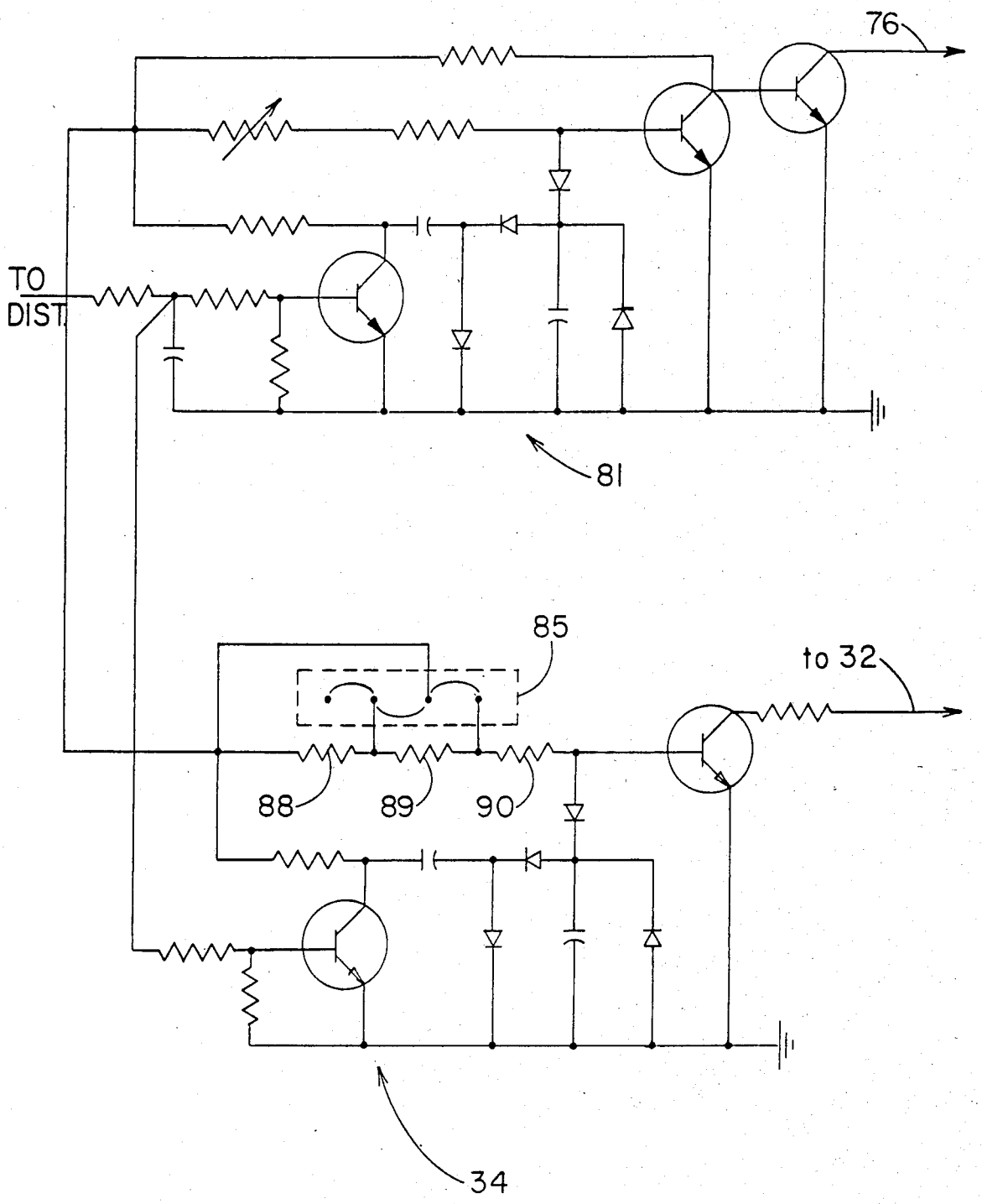
FIG. 5 is a detailed circuit illustration of one portion of the FIG. 1 block diagram.

Referring to FIG. 5, underspeed circuit 34 and overspeed circuit 81 are illustrated in greater detail. While the actual style of circuits for these two functional blocks may vary, and variations are believed to be well known in the art, the detailed circuitry is provided so that the operation of selector switch 85 can be better illustrated. Selector switch 85 is a dip switch that is settable to one of four positions. These four positions correspond to either a four-cylinder, six-cylinder, or eight-cylinder or diesel engine which correspond to the majority of present-day vehicles. Switch 85 provides yet another means of individually tailoring the system for the type of vehicle on which the system is installed. Again, while a dip switch is used, the choice as to the number of cylinders could be made by hard-wiring the switch contacts to their proper locations within the resistor series at the time the system is installed. This series of resistors includes resistors 88, 89 and 90, and the varying ohm values, depending on the point of connection, tailor this portion of the system circuitry to the number of cylinders present in the engine.

Should someone raise the hood during or before the system is activated, a ground signal is established on line 76 which couples to the reset pin of the timer 29 turning the timer off and thereby preventing bodily harm. Should the engine become over-revved, the system has an overspeed frequency circuit section 81 that is connected to the distributor or diesel means of the engine and if too many pulses are present over a particular time duration, the frequency circuit section establishes a ground signal on line 76 which is coupled to the reset pin of timer 29 and the presence of this ground signal turns off the timer and thereby prevent damage to the engine.

The system can also be turned off and kept off indefinitely by a dashboard switch or similar disconnect means. This switch is connected to chassis ground and when closed it supplies the necessary ground signal for the starter system. With the switch open, the starter system is immune to signals from the remote control transmitter or the clock. This switch is normally closed, but is used if a defect should occur and it should be used while working on the vehicle to prevent inadvertent start-ups.

Underspeed delay circuit section 34 supplies power for relay 36 as well as to timer 37 by way of diode 38. Since relay 36 does not have a ground signal, it cannot function and when timer 37 is turned on, its output is high and this is connected to the low terminal of the relay and the relay remains off until timer 37 times out and the output goes low. When this happens, relay 36 engages, supplying starter current to the park-neutral switch 47. Relay 36 is not chassis grounded and it needs a ground in order to operate properly. It receives this ground signal in order to operate when timer 37 times out approximately 7 seconds after power is applied by way of diode 38. Power is supplied from underspeed delay circuit section 34 for relay 36 and to timer 37.

One facet of the present invention is a means for bypassing the energizing/deenergizing means when the engine temperature of the vehicle is above a predetermined level. This predetermined engine temperature level is established by the amount of time the engine has been turned off rather than using a temperature switch. One reason for this approach is that during extremely cold weather, an external temperature switch will cool down prematurely due to the outside chill factor and will not properly reflect the actual internal engine temperature. The result is a false signal to the pedal pumping circuit which causes the gas pedal to be pumped as if the system was being properly triggered. This could result in flooding the engine. Therefore, the use of time in determining the gas pedal pumping is considered not only a more accurate means but a more reliable means, depending on the weather conditions. The normal time is approximately 2 hours after the ignition is off before the gas pedal would be permitted to be pumped by the presently designed circuitry. This approach allows for a normal cool-down of the engine.

As previously disclosed, the distributor is commonly connected to both the underspeed circuit block as well as the overspeed circuit block, and while this is the normal approach for conventional vehicles, a slight modification is required in the event the system is installed on a diesel engine. Under diesel circumstances, the distributor connection is replaced with diesel means and upon a start signal from the clock or receiver, the system switches to the run mode bypassing the underspeed circuit section for approximately a ¼ to 1-second duration. During this time period (run mode) the ignition and accessory relays are engaged causing the glow plugs to be heated if necessary. If the signal from the vehicle glow plug circuit to the wait light is present, the system will remain in the run mode until such signal disappears approximately 2–20 seconds, or as determined by the vehicle glow plug circuitry. Upon losing this signal or if no signal was initially present, the system will revert back to the normal start-up procedure as preprogrammed according to selector switch 40. It is envisioned that a pick-up coil will be installed on the engine in such a manner so as to detect engine RPM's. This pick-up coil substitutes for the distributor of the engine and sends pulses to the various frequency-to-voltage conversion circuits (underspeed circuit and overspeed circuits) in order to allow the necessary decision functions to be made.

Figure 6:
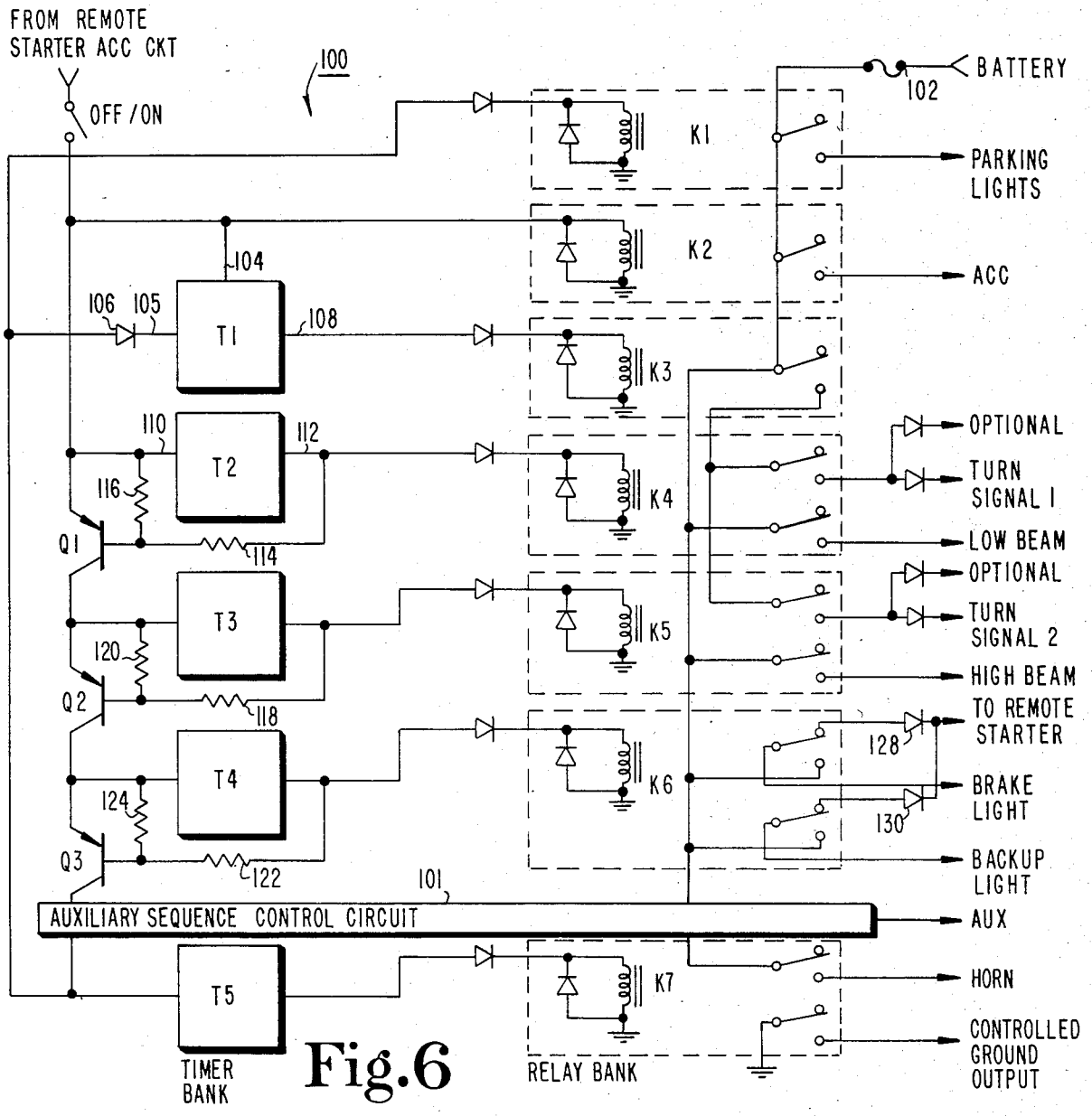
FIG. 6 is a block diagram illustration of an electronic detection device for use with an automatic vehicle starting system according to a typical embodiment of the present invention.

Referring now to FIG. 6, the preferred embodiment of an electronic detection device according to the present invention is shown in block diagram form. The electronic detection device is preferably used with the automatic starting system just described, so as to enable a vehicle operator to start the vehicle from a safe distance and scan various electrical system components to check for explosives wired to the electrical system. Electronic detection device 100 connects to remote starter 10 shown in FIG. 1 via the remote starter accessory (ACC) circuit (FIG. 3) which, as can be seen in FIG. 6, is connected to the OFF/ON switch of detection device 100. The OFF/ON switch is provided to enable an operator to turn the detection device off if desired, but normally this switch is left on so that detection device 100 is operable each time the vehicle is started.

As will be described, if the OFF/ON switch is turned off, detection device 100 will be unable to complete its test sequence and this fact will be readily apparent to the device operator as an indication that the vehicle has not been scanned, and the operator may then take appropriate action.

With continuing reference to FIG. 6, the general operation of detection device 100 will now be described. The circuit begins operation upon receiving power from the remote starter accessory (ACC) circuit (FIG. 3) through the OFF/ON switch. The remote starter ACC circuit is disabled until the engine is running but thereafter supplies battery current to a timer bank, comprising timers T1–T5, which controls the sequence of operation of a relay bank comprising relays K1–K7. An auxiliary sequence control circuit 101 includes such other timer and relay bank components as may be required to sequentially control other electrical system components of particular models of vehicles in which the system is installed. Since different models have different auxiliary systems, the output of this circuit is indicated simply as AUX, however it will be understood that this circuit includes separate output lines, and associated circuitry, for each auxiliary system desired to be sequentially controlled. For simplicity, the preferred embodiment will be described without detailed reference to sequential control of auxiliary systems, it being understood that the description of the illustrated timers and their respective relays and transistors applies generally to auxiliary sequence control circuit 101.

The enumerated relays in the relay bank are actuated in a predetermined sequence summarized below in terms of the electrical system components energized at each step in the sequence:

| Step | Circuit Activated | Time |
|---|---|---|
| 1 | Accessories | Continuous |
| 2 | Turn signal 1 (flashing) & Low beam | 4 seconds |
| 3 | Turn signal 2 (flashing) & High beam | 4 seconds |
| 4 | Brake & Backup lights | 4 seconds |
| 5 | Horn | 0.5 seconds |
| | Parking lights | Continuous |

The vehicle's electrical system components are energized sequentially so as to limit the instantaneous current drain from the vehicle's battery and charging system. In the event that no bomb is detected by the electronic detection device of the present invention, it is obviously desirable that the vehicle engine, having been remotely started moments before, remain running. The current drain from simultaneously energizing headlights, fan motors and other accessories in the vehicle would be high enough in some cases, such as starting a cold or poorly tuned engine, that it would cause the engine to stall. The present invention, in its preferred embodiment, reduces the risk of stalling by maintaining at least one of the electrical system components deenergized at any one time during the predetermined sequence. At the end of the predetermined sequence, the horn and parking lights are energized, as will be described, to provide an aural and visual indication that the sequence has been completed. Also, the preferred embodiment sequences through the above steps sufficiently slowly that an operator of the device or an assistant can easily observe the entire sequence. This last aspect provides a person maximum reassurance that the complete vehicle electrical system has been scanned.

The operation of electronic device 100 will now be described in detail. The OFF/ON switch is normally on, as has been described. When the remote starter ACC circuit supplies power to detection device 100, timers T1 and T2 and relay K2 simultaneously receive power. It should be noted that all relays in the relay bank of FIG. 6 are shown schematically with their switch elements in their deenergized positions, i.e., with each switch common connected to its respective normally closed contact. Battery current is conducted from the vehicle battery through fuse 102 to the common contacts of relays K1–K3, to the lower common contacts of relays K4 and K5 as illustrated in FIG. 6, and to both normally open contacts of relay K6. The line from the battery further connects to the upper common of relay K7 through auxiliary sequence control circuit 101. Thus, when K2 is energized battery power is supplied to the ACC output of electronic detection device 100 through the normally open contact of K2.

At the same time as K2 is energized, power is also applied to timer T1 along line 104. Timer T1 also receives an input on line 105 through diode 106, which input will be described later. T1 is shown in detail in FIG. 7 and will be described with reference thereto. T1 is a conventional 555 integrated-circuit (IC) timer depicted in block diagram form, which is an alternative form to that of FIGS. 2–4. T1 is connected, in a conventional fashion, for operation in astable mode: A timing resistor R1 is connected between the O (output) terminal and the TH and TR (threshold and trigger) input terminals of the 555 timer, and a timing capacitor C1 is connected from the TH and TR inputs to ground. Line 104 connects to the V (supply voltage) input of the timer, as well as to the R (reset) input to disable that input. A conventional bypass capacitor C2 is connected between the V input and ground to reduce noise. Diode 106 is reverse biased at this time, thus no current flows through that diode and line 105 may accordingly be viewed as an open circuit. Thus, the supply voltage on line 104 causes timer T1 to cycle on and off at a fixed rate determined by the values of timing resistor R1 and timing capacitor C1. Those values are preferably selected such that the on and off times of T1 are each 0.75 seconds. The output signal from timer T1 is supplied on line 108 to relay K3 through a series diode, as shown in FIG. 6. Relay K3 repetitively engages and disengages in response to the T1 timer output signal, thereby repetitively supplying power to and removing power from the upper-shown common contacts of K4 and K5 through the normally open contact of K3.

Figure 8:
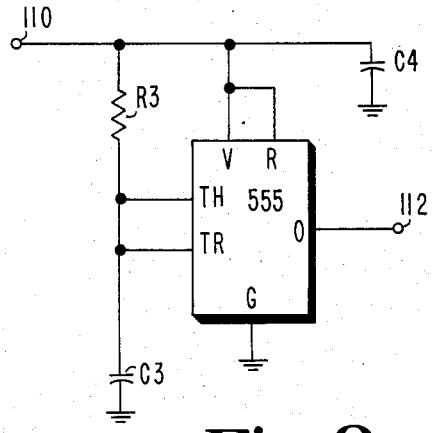
FIG. 8 is a detailed circuit illustration of one portion of the FIG. 6 block diagram.

T2 is supplied with power at the same time as T1 and accordingly begins its own timing function, which will now be described. FIG. 8 shows the detailed circuitry for timer T2 as well as timers T3–T5. For all timers T2–T5, the circuit configuration is, as shown in FIG. 8, a conventional 555 IC timer connected to a timing resistor R3 and timing capacitor C3 for operation in monostable mode (one-shot operation). The durations of the one-shot pulses for T2–T5 vary according to the values of each timer's timing resistor R3 and timing capacitor C3, but the configuration of each is identical. The preferred duration for the one-shot pulses of T2–T4 is approximately four seconds each, corresponding with the times indicated previously for steps 2–4 of the predetermined operating sequence. One-shot T5 is set to time out in approximately one-half second. The values of R3 and C3 for each one-shot are chosen accordingly, in a conventional manner. A bypass capacitor C4 is also provided for each one-shot. As stated, T2 is set to produce a pulse lasting approximately four seconds. The output pulse for timer T2 is high, as are all the one-shot output pulses, thus T2 energizes K4 for approximately four seconds. It will be appreciated that timers T1 and T2 cooperate to cause a pair of turn signals (designated TURN SIGNAL 1) to flash, and to cause repetitive energization of an optional component, such as a turning light, which may be visually inspected by an operator at the same time as a turning signal. Timer T2 independently causes the headlight low beams to turn on continuously for four seconds. The respective OPTIONAL and TURN SIGNAL outputs are connected to each other through two diodes with interconnected anodes, as shown, so as to electrically isolate the circuits connected to the two outputs during normal vehicular operation.

Up to this point in the sequence, the three illustrated transistors Q1–Q3 have been off. For this reason, T3–T5 have not been triggered nor has diode 106 been connected to a source of power. However, once timer T2 times out, its output goes low thereby drawing current through the base of transistor Q1 and resistor 114, and Q1 consequently turns on. Resistor 116 is provided to insure that transistor Q1 is held off initially on power turn-on and does not "float" on until the proper signal level is reached.

When Q1 turns on, T3 receives power and begins its timing cycle. Timer T3 produces a high output signal for four seconds during which time K5 is engaged causing power to be applied to the headlight high beams. Also, since timer T1 is still cycling on and off, T1 and T3 cooperate to cause the other pair of turn signals (designated TURN SIGNAL 2) and another optional component, such as the other turning light, to flash. When T3 times out, transistor Q2 turns on and activates the next timer in the chain (T4) in the same manner as described above for Q1 with respect to T3. It should be noted that Q1 remains on since the output of T2 remains low, thus Q1 conducts current to Q2. This principle extends to transistor Q3 as well. Resistors 118 and 120 provide the same function as resistors 114 and 116 already described.

Similarly, during the timing cycle of timer T4, relay K6 is energized whereby electrical power is supplied to the brake lights and backup lights of the vehicle. Timer T4 is also set to time out after approximately four seconds. When timer T4 times out, K6 is deenergized and the common contacts of the relay revert to the normally closed contact positions, which are connected to the remote starter through diodes 128 and 130. The purpose for this connection to the remote starter will be explained below. When timer T4 times out, it causes the next transistor in the chain, Q3, to turn on through resistor 122 connected to its output. Resistors 122 and 124 are provided for the same purposes as resistors 114 and 116 already described. When Q3 turns on, power is applied to auxiliary sequence control circuit 101, which, as described, may contain transistors, timers and relays interconnected and operable in the same manner as other such components which have already been described.

In turn, sequence control circuit 101 applies power simultaneously to timer T5, relay K1 and, through diode 106, to input line 105 of timer T1. During the timing cycle of timer T5, approximately 0.5 seconds, the horn sounds due to energization of relay K7, and a ground signal is sent out on the controlled ground output of detection device 100. Energization of relay K1 causes the parking lights to turn on. The controlled ground output is supplied so that a ground signal may be sent out to an optional circuit, if needed, such as an auxiliary cooling fan or other component requiring a ground for operation.

Figure 7:
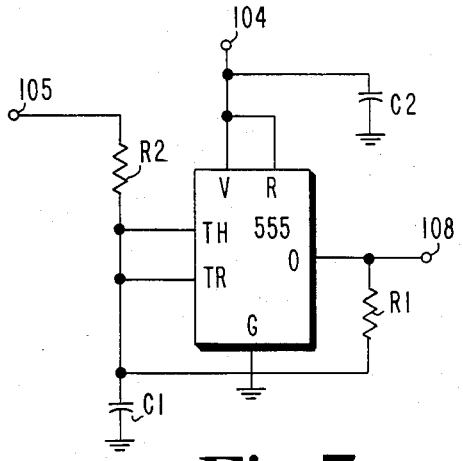
FIG. 7 is a detailed circuit illustration of one portion of the FIG. 6 block diagram.

When sequence control circuit 101 applies power to line 105, the voltage level on that line is approximately the battery voltage, neglecting voltage drops across the transistors and diode 106, and the output voltage level on line 108 is either high or low depending on the current state of the oscillator. The resistive divider consisting of resistors R2 and R1 is designed such that, with this set of conditions, the threshold level of the 555 timer continuously exceeds $\frac{2}{3}$ V+. As is well known, a 555 timer configured as shown in FIG. 7 operates between threshold levels of $\frac{1}{3}$ V+ and $\frac{2}{3}$ V+. By pulling the threshold up through R2 to a voltage level above $\frac{2}{3}$ V+, the oscillation of T1, and the corresponding repetitive energizing of K3, is terminated. As can be understood from the above description, detection device 100 causes the vehicle's horn to sound for half a second at the end of the test sequence and additionally turns on the vehicle's parking lights.

The parking lights remain on continuously until the remote starter 10 times out, approximately 12–14 minutes. When the remote starter times out, power is disconnected from the remote starter ACC circuit line, and K1 consequently disengages. As indicated, the described operation of the horn and parking lights at the end of the sequence provides confirmation that the entire sequence has been run.

The connections to the remote starter through diodes 128 and 130 are provided to turn off the vehicle engine through the remote starter system should someone depress the brake pedal or put the vehicle in reverse gear. As has been described, these are safety features of the remote starter designed to prevent accidents such as from child play around the vehicle with the engine running. These connections to the remote starter must be disconnected during the test sequence of detection device 100 in order to prevent premature engine turn-off, and the connections through K6 are provided for this purpose.

The electronic detection system of the invention may also be used to detect malfunctions in the vehicle's electrical system. The system provides enough time for a vehicle operator to walk around the vehicle and observe the automatic operation of each system component by electronic detection device 100. Thus, at the push of a button and without assistance from any other person, a driver may quickly inspect all the lights and accessories of his vehicle before driving off. In this regard, it should be understood that the purpose for flashing the turn signals is to simulate the operation of the vehicle's own flashers and thereby provide the most realistic test.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, it will be readily understood by those skilled in the art that the number of timers in auxiliary sequence control circuit 101 and the specific timing cycles of all the timers in the system may be varied in accordance with particular sequence control requirements, and the teachings of the present invention may be extended to actuation by any desired vehicle electrical components according to a desired testing sequence.

What is claimed is:

1. An automatic detection system for a vehicle having a battery and a plurality of electrical system components, comprising:

(a) means remote from said vehicle for generating an actuation signal;

(b) means for selectively supplying power to said plurality of electrical system components including vehicle headlights, indicator lights and horn, said supplying means including a plurality of separately actuatable switch means for energizing particular ones of said electrical system components;

(c) sequence control means responsive to said actuation signal for actuating said plurality of switch means in a predetermined sequence; and (d) means for maintaining at least one of said electrical system components deenergized at any one time during the predetermined sequence, wherein said sequence control means is operative to automatically sequence entirely through the predetermined sequence in response to said actuation signal, whereby all of said electrical system components are automatically energized in response to a single actuation signal while the instantaneous current drain from the battery of said vehicle is limited.

2. The automatic detection system of claim 1 wherein said remote means includes transmitter means for transmitting said actuation signal to said vehicle, and wherein said sequence control means is located in said vehicle and includes receiver means for receiving said actuation signal from said transmitter means.

3. The automatic detection system of claim 2 wherein said sequence control means includes first and second integrated-circuit timers and means for triggering said second timer when said first timer times out.

4. The automatic detection system of claim 3 wherein said electrical system components further include parking lights, wherein said supplying means includes horn switch means for energizing said horn and light switch means for energizing said parking lights, and wherein said sequence control means further includes means for actuating said horn switch means and said light switch means at the end of the predetermined sequence whereby operation of said horn and said parking lights provide aural and visual indication of the completion of the predetermined sequence.

5. The automatic detection system of claim 4 wherein said indicator lights include turn signals, said supplying means further includes turn signal switch means for energizing said turn signals, and wherein said sequence control means further includes means for repetitively actuating said turn signal switch means during the predetermined sequence.

6. A method of automatically detecting the condition of electrical system components of a vehicle having a battery and a plurality of electrical system components, said method comprising the steps:

(a) generating an actuation signal at a location remote from said vehicle;

(b) selectively supplying power to a plurality of electrical system components including vehicle headlights, indicator lights and horn, said supplying step including energizing particular ones of said electrical system components through a plurality of separately actuatable switch means;

(c) actuating said plurality of switch means in a predetermined sequence in response to said actuation signal, and (d) maintaining at least one of said electrical system components deenergized at any one time during the predetermined sequence, wherein said actuating step includes sequencing entirely through the predetermined sequence in response to said actuation signal, whereby all of said electrical system components are automatically energized in response to a single actuation signal while the instantaneous current drain from the battery of said vehicle is limited.

7. The method of claim 6 further comprising the steps:

(e) transmitting said actuation signal to said vehicle; and (f) receiving said actuation signal with a receiver located in said vehicle, wherein said actuating step is accomplished with a sequencer located in said vehicle and actuated by said receiver in response to reception of said actuation signal, said sequencer including means for automatically sequencing entirely through the predetermined sequence once actuated.

8. The method of claim 7 wherein said electrical system components further include parking lights, said method further comprising the step:

(g) intermittently energizing said horn and continuously energizing said parking lights at the end of said actuating step whereby operation of the vehicle horn and parking lights provides aural and visual indication of the completion of the predetermined sequence.

9. The method of claim 8 wherein said indicator lights include turn signals, said method further comprising the step:

(h) automatically, repetitively energizing said turn signals during said actuating step.

10. The method of claim 9 wherein said vehicle includes an internal combustion engine and a starter circuit for starting said engine, said method further comprising the step:

(i) conducting current from said battery to said starter circuit in response to reception of said actuation signal and before commencing said actuating step, whereby said vehicle engine is running when said actuating step is performed.

* * * * *